US006655312B1

(12) United States Patent
Pollack

(10) Patent No.: US 6,655,312 B1
(45) Date of Patent: Dec. 2, 2003

(54) ACTIVE SEMI-WEATHERVANING ANCHORING SYSTEM

(75) Inventor: Jack Pollack, Monaco (MC)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 10/049,235

(22) PCT Filed: Aug. 8, 2000

(86) PCT No.: PCT/EP00/07733

§ 371 (c)(1),
(2), (4) Date: May 9, 2002

(87) PCT Pub. No.: WO01/10707

PCT Pub. Date: Feb. 15, 2001

(30) Foreign Application Priority Data

Aug. 9, 1999 (EP) ..... 99202602

(51) Int. Cl.[7] ..... B63B 21/24
(52) U.S. Cl. ..... 114/293
(58) Field of Search ..... 114/293, 144 B, 114/230.22; 440/34

(56) References Cited

U.S. PATENT DOCUMENTS 653,475 A * 7/1900 Howe et al. ..... 440/34
1,160,257 A * 11/1915 Burns ..... 440/34

FOREIGN PATENT DOCUMENTS

| | | |
|---|---|---|
| DE | 42 29 869 | 9/1993 |
| EP | 0 878 388 | 11/1998 |
| FR | 2 269 134 | 11/1975 |
| GB | 1 540 035 | 2/1979 |
| WO | WO 99/02394 | 1/1999 |

* cited by examiner

*Primary Examiner*—Ed Swinehart
(74) *Attorney, Agent, or Firm*—Young & Thompson

(57) ABSTRACT

An anchoring system includes a vessel and one or more anchor lines extending from a first anchor to a pulling device on the vessel and from there on to a second anchor. The anchor line may extend transversely to the length direction of the vessel, or may extend parallel to the length direction of the vessel, offset from the longitudinal or transverse centre-lines. The anchoring system provides an active semi-weathervaing capability whereby heave and roll motions may be significantly reduced. Accurate station keeping maybe achieved with a relatively small number of pulling devices, the pulling force of which can be relatively small.

10 Claims, 4 Drawing Sheets

ACTIVE SEMI-WEATHERVANING ANCHORING SYSTEM

BACKGROUND OF THE INVENTION

The invention relates to an anchoring system comprising a vessel, at least two anchors and an anchor line connecting the anchors to the vessel, wherein the anchor line extends from a first anchor, to a pulling device on the vessel, and from the pulling device to the second anchor.

From WO98/45874 it is known to moor a vessel, such as an FPSO, to the sea bed with mooring lines which are secured to the ship's hull in the central area. By pulling in or paying out the anchor line via securing devices on the side of the vessel, the vessel may be rotated through 180° around a vertical axis to be aligned with prevailing wind and current conditions.

From WO-97/47516 an anchoring system for positioning an offshore vessel is known wherein bow and stem anchor lines are connected to respective winches at the bow and the stem of the vessel. The vessel may be rotated by varying the lengths of the anchor lines by means of the winches.

From European patent application EP-A-878389 an anchoring system is known in which bow and stern anchor lines are interconnected and extend in the length direction across the deck of the vessel via a winch for allowing passive semi-weathervaning of the vessel.

The known mooring systems have as a disadvantage that a relative large number of winches need to be applied, which winches have to be of a relatively large size to generate a lifting force directed against the tension in the mooring lines, which may amount to 100 tons or more. Furthermore, the possibilities for station keeping and directional adjustments are relatively limited in the known passive semi-weathervaning system.

SUMMARY OF THE INVENTION

It is therefore an object of the present invention to provide a semi-weathervaning anchoring system which utilises a relatively small number of pulling devices of relatively small pulling power. It is a further object of the present invention to provide an anchoring system by which heave and roll motions of the vessel can be significantly reduced, and by which active weathervaning is possible.

Thereto the anchoring system according to the present invention is characterised in that the anchor line is located at a distance from the longitudinal or transverse centreline of the vessel.

By running the anchor line across the vessel at a distance from the longitudinal or transverse centrelines of the vessel through a pulling device, one part of the anchor line can be taken in while the other is paid out to cause a rapid and simple adjustment of the vessel position and/or direction. As one pulling device operates on two anchor lines, the number of pulling devices remains relatively low. Furthermore, as the anchor line parts are tensioned against each other, the pulling device only has to operate against the difference in anchor line tension so that the pulling power of the pulling device can be relatively small.

The vessel of the present invention may be a floating production storage and offloading (FPSO) vessel which may or may not have drilling capabilities (FPDSO) or may be a drilling vessel with a tension leg deck (TLD) such as described in European patent application No. 99200823.5. The anchor lines may be comprised of anchor chains, steel cables, polyester cables, or combinations thereof. The anchor lines may be formed of one piece or may be interconnected at the position of the vessel. The anchor line may comprise two separate sections that each are connected to the pulling device.

The pulling device may comprise a winch, or other equivalent pulling means such as an hydraulic arm or a pinion and rack combination.

The anchors may comprise pile, drag or suction anchors connected to the seabed, and the mooring lines may comprise clump weights or other anchoring equipment for maintaining a stable position of the vessel.

In one embodiment, the anchors are placed on each side of the longitudinal centreline, the pulling device being placed on the forward or rear part of the vessel. By placing the pulling device on the rear part of the vessel, the bow of the vessel can be rotated through about plus or minus 45°. A 30° weathervaining adjustment can already reduce heave and roll motions by as much as 50%.

In a further embodiment both the front and rear parts of the vessel comprise a pulling device such that also lateral displacement and yaw motions of the vessel can be adjusted and/or corrected. Near midship of the vessel, a number of anchor lines that extend in the transverse direction may be fixedly connected or may be connected via additional pulling devices for lateral displacement of the vessel.

Another embodiment comprises an anchor line configuration in which two anchor lines extend in the longitudinal direction of the vessel, on both sides of the longitudinal centreline thereof. Each anchor line comprises a pulling device at the side of the vessel, the anchor lines being guided through fairleads at the bow and at the stem and from thereon continuing towards the anchors.

BRIEF DESCRIPTION OF THE DRAWINGS

A number of embodiments of an active semi-weathervaning anchoring system according to the present invention will be explained in detail with reference to the accompanying, non-limiting drawings. In the drawings.

DETAILED DESCRIPTION OF THE PREFERRED EMBODIMENTS

Figure 1:
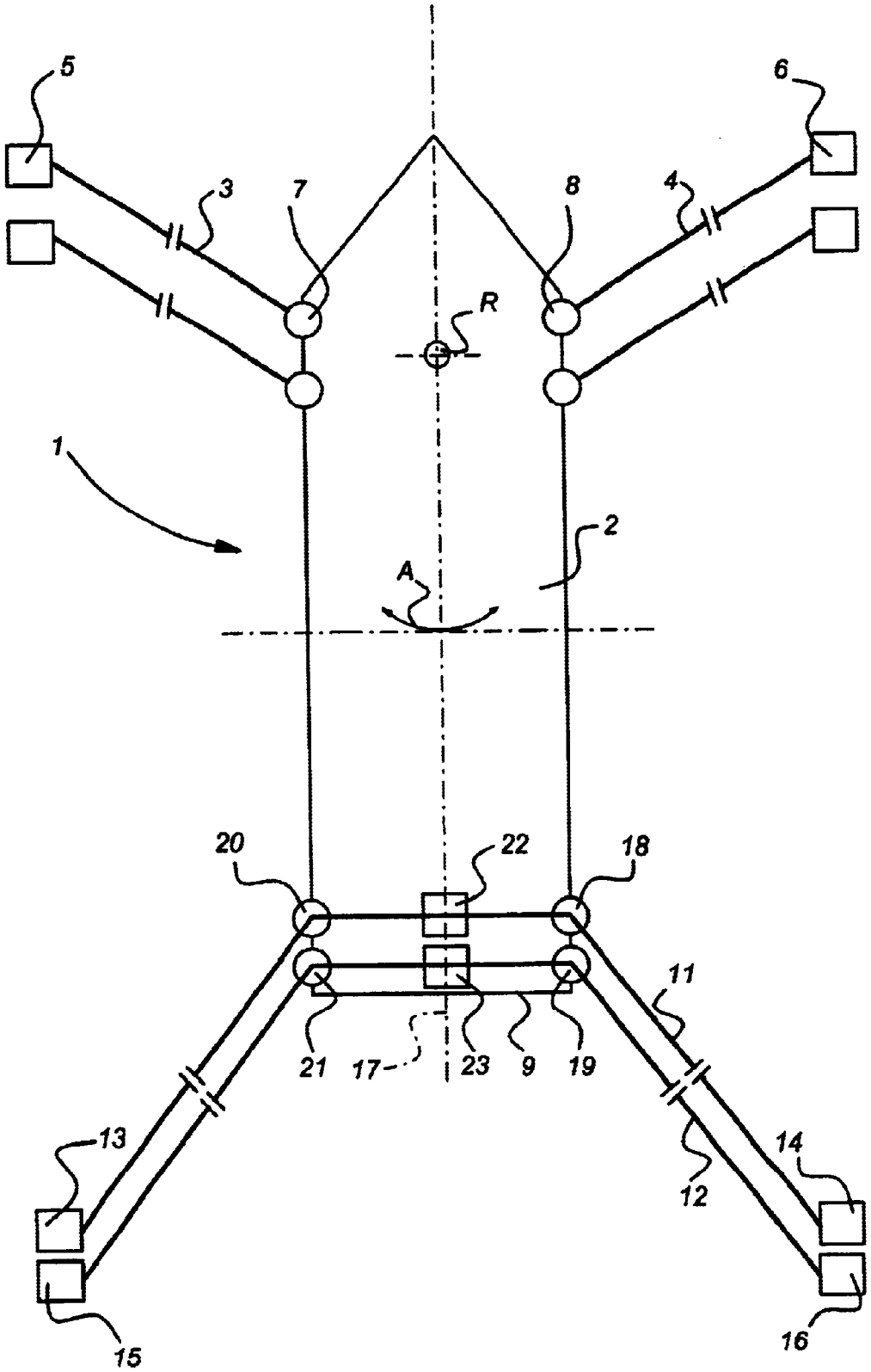
FIG. 1 shows an embodiment wherein two adjustable anchor lines extend transversely to length direction at the rear end of the vessel.

FIG. 1 shows an anchoring system 1 according to the present invention comprising a vessel 2 and bow anchor lines 3, 4 that are on one end connected to anchors 5, 6 and that with their other ends are fixedly connected to the vessel 2 via fairleads 7, 8. At the stern 9 of the vessel two anchor lines 11, 12 extend between anchors 13, 14, 15, 16 which are located on respective sides of a longitudinal centreline 17. Each anchor line 11, 12 is movably guided via a respective fairlead 18, 19, 20, 21 and is connected to a respective pulling device 22, 23, at the stem of the vessel. By actuating the pulling devices 22, 23, the stem 9 can be laterally displaced such that the bow of the vessel can be headed against the prevailing wind and current directions by rotation of the vessel around the point R, such as schematically indicated by the arow A.

Figure 2:
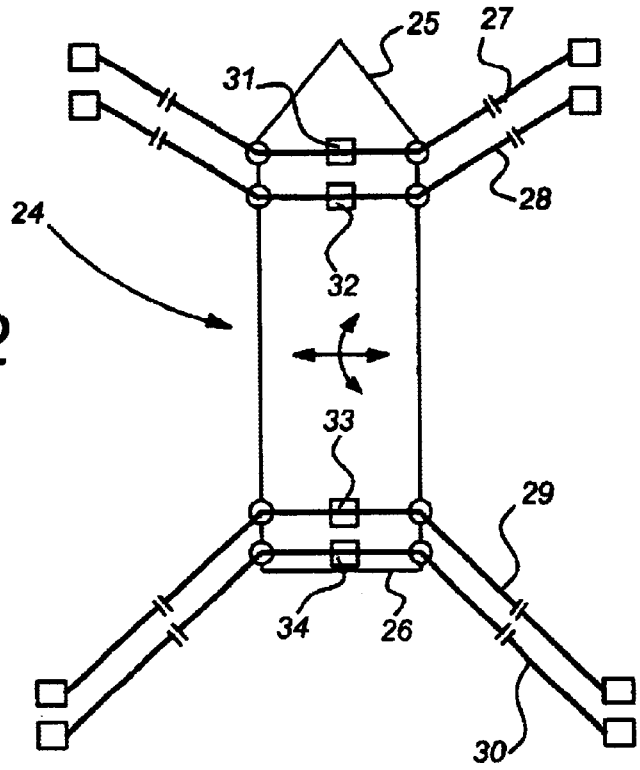
FIG. 2 shows an embodiment of an anchoring system with adjustable anchor lines at the bow and stem of the vessel.

FIG. 2 shows the embodiment of a vessel 24 wherein at the bow 25 and the stern 26 each time two anchor lines 27, 28; 29, 30 are connected to respective pulling devices 31, 32, 33, 34. In this embodiment, the lateral position of the vessel may be adjusted and yaw motion around the vertical centreline of the vessel may be corrected.

Figure 3:
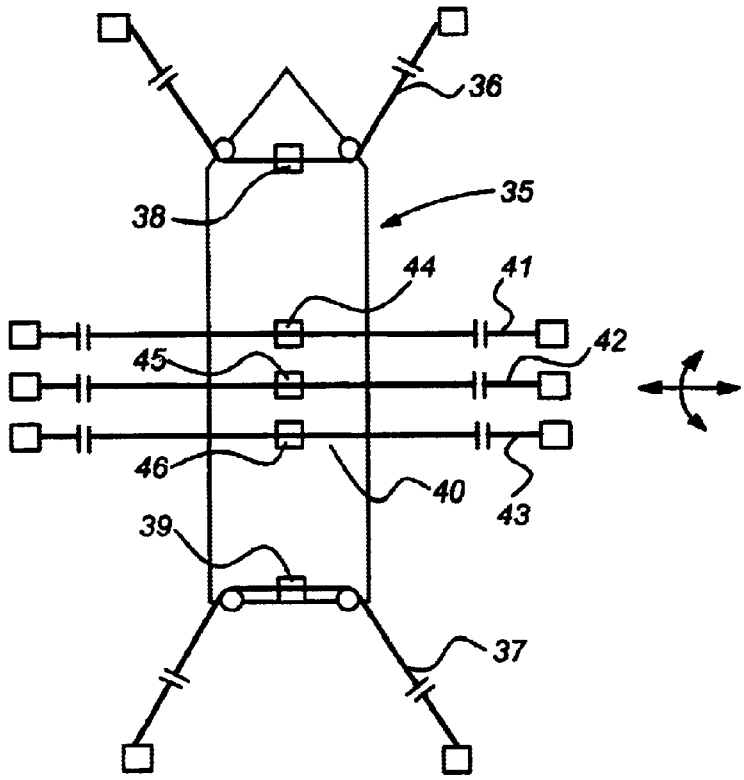
FIG. 3 shows an embodiment wherein additional adjustable anchor lines are provided near midship.

FIG. 3 shows an embodiment of a vessel 35 comprising a bow anchor line 36 and a stem anchor line 37 each connected to respective pulling device 38, 39. At a midship position 40, three anchor lines 41, 42, 43 run across the deck of the vessel in a transverse direction via pulling devices 44, 45 and 46. This configuration is especially useful for FPDSO-vessels with drilling/work over rigs, or in combination with a tensionleg deck such as described in European patent application number 99200823.5 in the name of the applicant.

Figure 4:
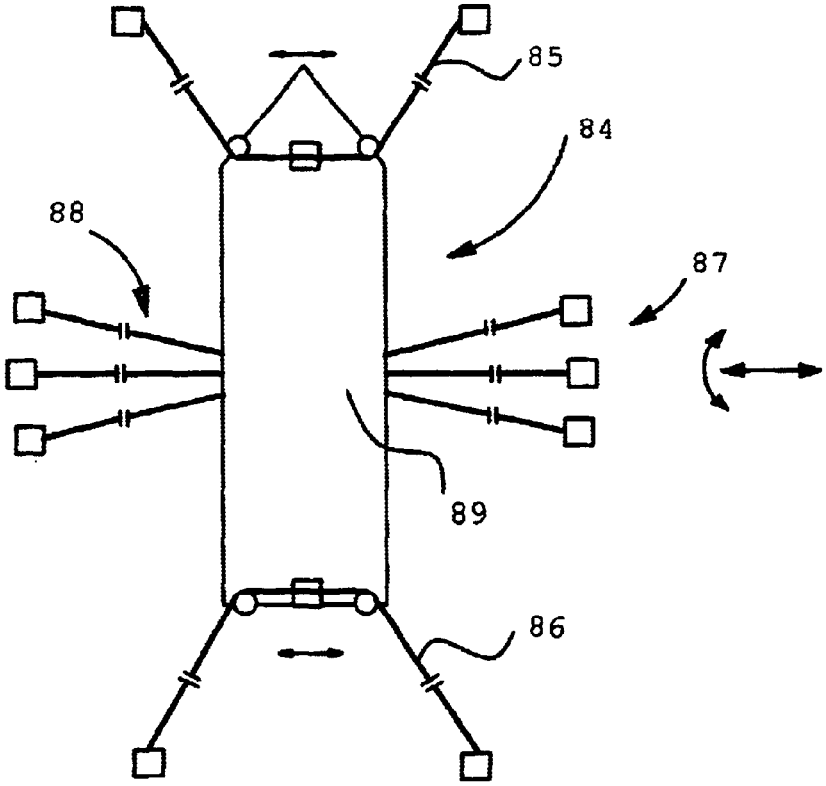
FIG. 4 shows an embodiment wherein the vessel near midship is provided with fixed anchor lines.

FIG. 4 shows an embodiment of a vessel 84 suitable for rotational positioning and small sideways translations, as schematically indicated by the arrows. In addition to adjustable bow anchor line 85 and stern anchor line 86, two pairs of fixed anchor lines 87 or 88 are provided, connected to the midship portion 89 of the vessel. The vessel can be rotated by pulling in and paying out the anchor lines 85, 86 while the holding power of the fixed lines 88, 87 can be retained without winching. This configuration is also favourable for use in conjunction with an FPDSO with drilling/work over rigs or with a tension leg deck (TLD constructions).

Figure 5:
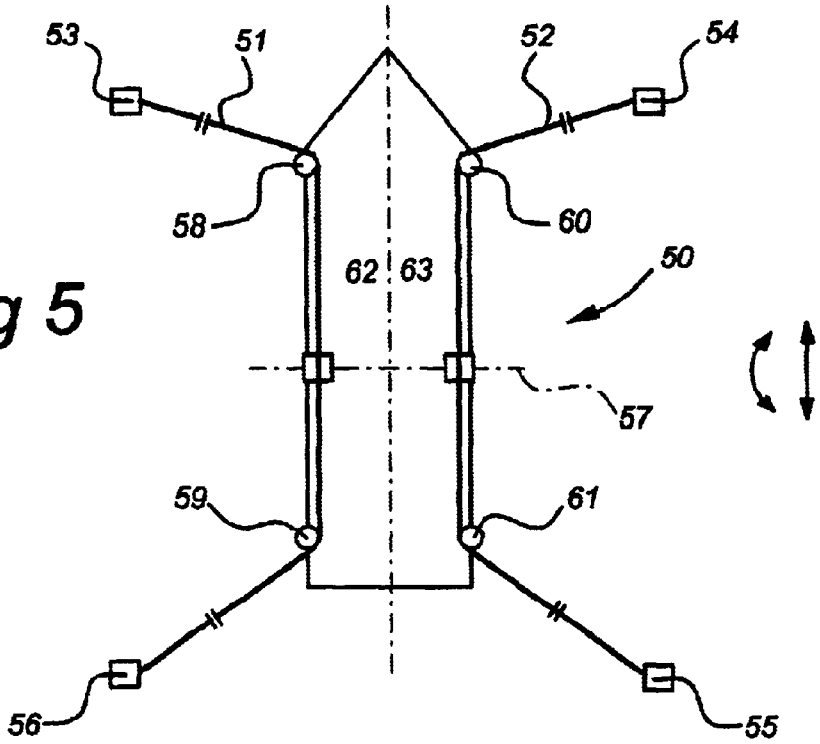
FIG. 5 shows an embodiment wherein the adjustable anchor lines extend on both sides of the longitudinal centreline, generally in the length direction of the vessel.

FIG. 5 shows an embodiment of a vessel 50 suitable for rotational positioning and large lengthwise translations as schematically indicated by the arrows. Two anchor lines 51, 52 are connected to anchors 53, 54, 55, 56. Each anchor line 51, 52 is connected to pairs of anchors 53, 56; 54, 55 located on either side of the transverse centreline 57. At the vessel 50, the anchor line sections extend in the length direction of the vessel between pairs of fairleads 58, 59; 60, 61. The pulling devices 62, 63 are located near the sides of the vessel 50 between the position of the fairleads 58, 59, 60, 61.

Figure 6:
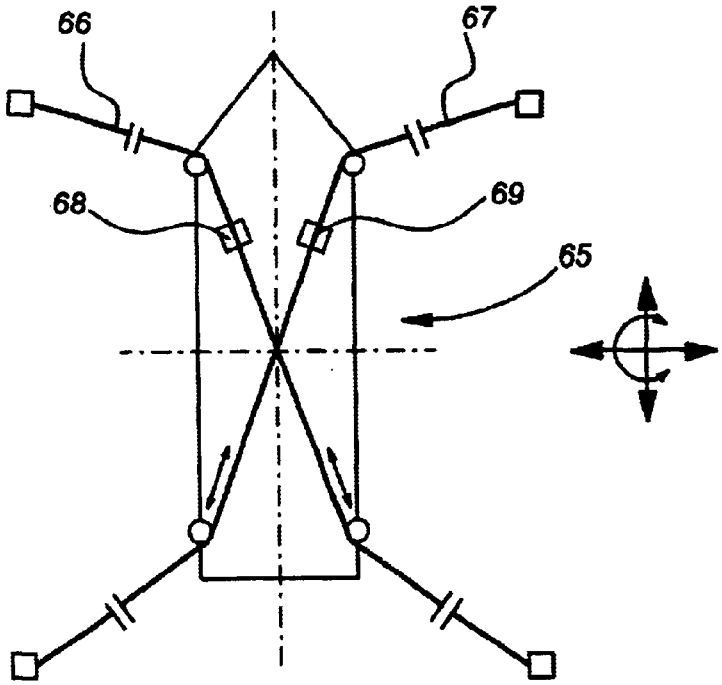
FIG. 6 shows an embodiment wherein the anchor lines cross the deck of the vessel.

FIG. 6 shows an embodiment of a vessel 65 suitable for small rotations and large lengthwise and sideways translations, as schematically indicated by the arrows. The vessel comprises two anchor lines 66, 67 which extend crosswise across the deck of the vessel 65, each anchor line 66, 67 being connected to a pulling device 68, 69. This arrangement is particularly useful for moving the vessel laterally. If for instance lines 66 and 67 are both winched toward the bow of the vessel, the vessel will move to the stern. If lines 66 and 67 are both winched toward one side, the vessel will move to the opposite direction. With differential winching the vessel can also be induced to turn while being translated.

Figure 7:
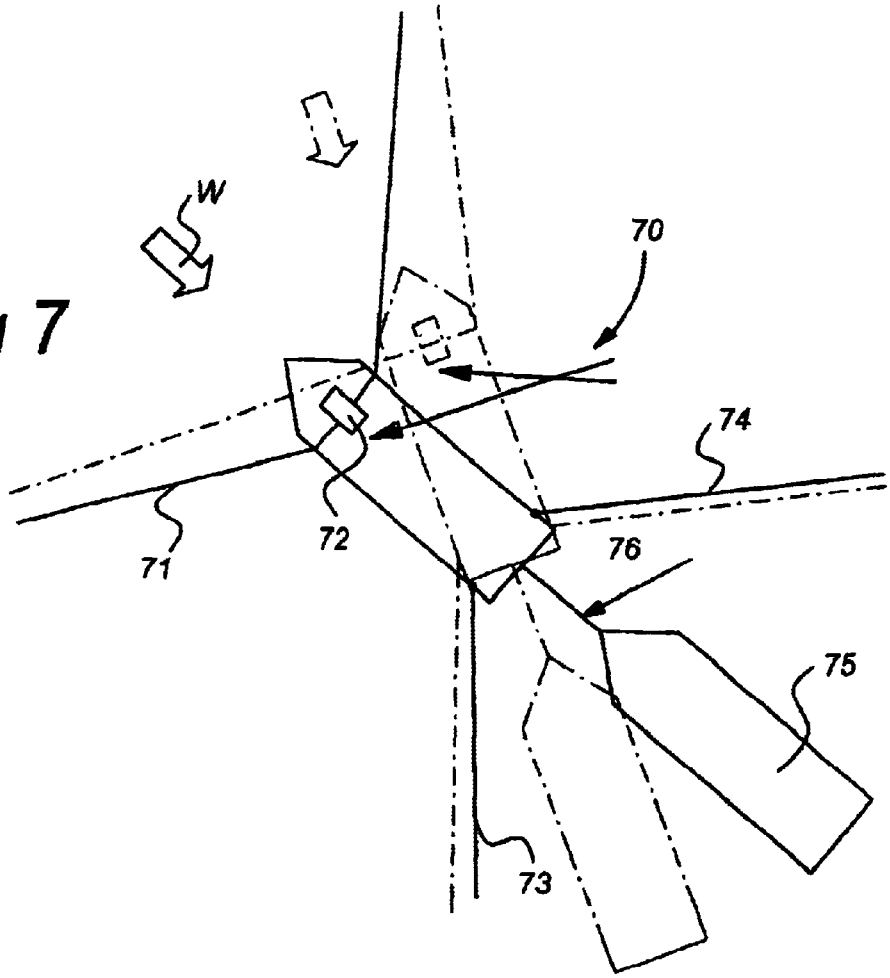
FIG. 7 shows an embodiment comprising two pairs of adjustable anchor lines extending in the length direction and in the transverse direction.

FIG. 7 shows an FPSO vessel 70 which is moored according to the present invention and which is connected to a shuttle tanker 75 in a tandem mooring configuration. The shuttle tanker 75 is with its bow connected to the stem of the vessel 70, via a hawser 76. The weather direction is indicated schematically by arrow W. The active weathervaning capabilities of the vessel 70 via anchorline 71 and pulling device 72, by plus or minus 45°, provide sufficient clearance for weathervaning of the shuttle tanker 75 and for keeping both vessels 70, 75 aligned with the weather. Weathervaning through plus or minus 45° of the vessel 70 and mooring of the shuttle tanker 75 to the bow when necessary, can keep the shuttle tanker 75 within a 180° sector.

In FIGS. 1–7 a detector, such as a wave signalling buoy can be used, in the vicinity of the moored vessels to send a radio signal to the vessel with prevailing wind and current directions, on the basis of which, by means of a control system known in the art, the pulling devices are actuated to adjust the position of the vessel.

What is claimed is:

1. Anchoring system comprising:

a vessel;

a pulling device on the vessel;

at least three anchors connected to a seabed;

a first anchor line connecting a first anchor to the vessel; and a second anchor line connecting a second and a third anchor to the vessel, the second anchor line extending from the second anchor, to said pulling device via a second attachment point on the vessel and from the pulling device to the third anchor via a third attachment point on the vessel, wherein the first anchor line is attached to the vessel at an attachment point on one side of a longitudinal centreline extending from a bow to a stern of the vessel or on one side of a transverse centreline extending transversely to the longitudinal centreline through a midship position, and wherein the second and third attachment points are placed on a side of the longitudinal transverse centreline opposite to the side of the first attachment point at a distance from the longitudinal or transverse centreline.

2. Anchoring system according to claim 1, wherein the second and third anchors are located on each side of the longitudinal centreline, the pulling device being placed on the forward or rear part of the vessel.

3. Anchoring system according to claim 1, further comprising at least one further anchor line, connected to another pulling device, said at least one further anchor line extends transversely to the longitudinal centerline at or near the midship part of the vessel.

4. Anchoring system according to claim 1, further comprising one or more additional anchor lines fixed to the vessel near the midship part without being connected to a pulling device.

5. Anchoring system according to claim 1, wherein the at least three anchors are placed on respective sides of the transverse centreline of the vessel.

6. Anchoring system according to claim 1, characterized in that the system comprises a detection device (80) for detecting any of wave, current or wind directions and/or magnitudes, the detection device being coupled to the pulling device for actuating the pulling device in dependence of the measured conditions.

7. Anchoring system according to claim 1, wherein on at least one side of the vessel, an offloading vessel is moored.

8. Anchoring system according to claim 1, wherein at one end of the vessel (70) a transport vessel (75) is moored.

9. Anchoring system comprising a vessel, at least two anchors and an anchor line connecting the anchors to the vessel, wherein the anchor line extends from a first anchor, to a pulling device on the vessel, and from the pulling device to the second anchor, wherein the anchor line is located at a distance from the longitudinal or transverse centreline of the vessel, wherein the anchors are located on each side of the longitudinal centreline, the pulling device being placed on the forward or rear part of the vessel, and wherein at the forward or rearward part of the vessel a respective pulling device is placed, two anchor lines, each connected to at least two anchors and to a respective pulling device extending transversely to the longitudinal centreline of the vessel.

10. Anchoring system comprising a vessel, at least two anchors and an anchor line connecting the anchors to the vessel, wherein the anchor line extends from a first anchor, to a pulling device on the vessel, and from the pulling device to the second anchor, wherein the anchor line is located at a distance from the longitudinal and transverse centreline of the vessel, wherein the anchors are placed on respective sides of the transverse centreline of the vessel, and wherein on each side of the longitudinal centreline one or more anchor lines extend to anchors placed on the respective sides of the transverse centreline, each one or more anchor lines being connected to a respective pulling device.

* * * * *